US006334224B1

(12) United States Patent
Chalberg et al.

(10) Patent No.: US 6,334,224 B1
(45) Date of Patent: Jan. 1, 2002

(54) WHIRLPOOL JET ASSEMBLY

(75) Inventors: Philip Edward Chalberg, Costa Mesa, CA (US); Kipley R. Marks, Saint Heliers Bay (NZ)

(73) Assignee: Hydrabaths, Inc., Santa Ana, CA (US)

( * ) Notice: Subject to any disclaimer, the term of this patent is extended or adjusted under 35 U.S.C. 154(b) by 0 days.

(21) Appl. No.: 09/458,592

(22) Filed: Dec. 9, 1999

(51) Int. Cl.[7] ..... A61H 33/04
(52) U.S. Cl. ..... 4/541.6; 4/541.4
(58) Field of Search ..... 4/541.6, 541.4; 239/428.5, 251, 261, 264, 587.4; 601/169

(56) References Cited

U.S. PATENT DOCUMENTS

| | | | | |
|---|---|---|---|---|
| 3,868,949 A | * | 3/1975 | Arneson | |
| 3,950,045 A | | 4/1976 | Hart | |
| 4,241,464 A | | 12/1980 | Buckwalter | |
| 4,349,923 A | | 9/1982 | Chalberg | |
| 4,407,455 A | | 10/1983 | Sargent | |
| 4,508,665 A | | 4/1985 | Spinnett | |
| 4,704,826 A | | 11/1987 | Kirkland | |
| 5,014,372 A | | 5/1991 | Thrasher et al. | |
| 5,095,558 A | | 3/1992 | Howard | |
| 5,217,163 A | | 6/1993 | Henshaw | |
| 5,271,561 A | | 12/1993 | Tobias et al. | |
| 5,291,621 A | | 3/1994 | Mathis | |
| 5,657,496 A | * | 8/1997 | Corb et al. | 4/541.6 |
| 5,810,257 A | | 9/1998 | Ton | |
| 5,810,262 A | | 9/1998 | Ton | |

* cited by examiner

*Primary Examiner*—Gregory L. Huson
*Assistant Examiner*—Khoa Huynh
(74) *Attorney, Agent, or Firm*—Leonard Tachner

(57) ABSTRACT

A whirlpool jet assembly has both an articulatable nozzle and a rotary face. The nozzle can be directed over a range of angles to provide a narrow stream of water and air to hit a selected spot. The rotary face is easily installed to fluidly and mechanically engage the end of the nozzle. When so installed, the rotary face sends the stream through at least two canted apertures which thereby generate torque to rotate a rotor in the face. The resultant circularly shaped stream impinges on a larger area. The user can readily install or remove the rotary face to select either configuration.

12 Claims, 6 Drawing Sheets

WHIRLPOOL JET ASSEMBLY

BACKGROUND OF THE INVENTION

1. Field of the Invention

The present invention pertains generally to the field of whirlpool bath and spa jet assemblies. More specifically, the invention herein relates to a jet assembly which provides a choice of either a rotary jet configuration or a stationary articulatable jet configuration depending upon whether a rotor is installed in or removed from the assembly.

2. Prior Art

There are prior art patents which disclose jet assemblies which may be configured by the user to operate as either a rotary jet to cover a large area of the body or an articulate stationary jet to impinge on a selected smaller area of the body. However, each such prior art patent discloses a jet assembly where in order to accomplish such reconfiguration, the user must first remove one component and then install another.

A search of the prior art reveals the following patents:

| | | |
|---|---|---|
| | 3,950,045 | Hart |
| | 4,241,464 | Buckwalter |
| | 4,349,923 | Chalberg |
| BI | 4,349,923 | Chalberg (Re-Examination) |
| | 4,407,455 | Sargent |
| | 4,508,665 | Spinnett |
| | 4,704,826 | Kirkland |
| | 5,014,372 | Thrasher et al |
| | 5,095,558 | Howard |
| | 5,217,163 | Henshaw |
| | 5,271,561 | Tobias et al |
| | 5,291,621 | Mathis |
| | 5,810,257 | Ton |
| | 5,810,262 | Ton |

Of the foregoing prior patents, the following appear to be most pertinent:

U.S. Pat. No. 5,810,262 to Ton is directed to a spa jet with interchangeable nozzles. As shown in FIGS. 1–3, the interchangeable spa jet includes a wall fitting assembly 11, an adjustable body assembly 13, a rotatable nozzle assembly 15, and an eyeball nozzle assembly 17. The adjustable body assembly 13 includes an adjustable jet face 33, which is sonically welded to an adjustable jet body 29. The jet body 29 mounts to rotate through a selected arc within the wall fitting assembly 11. The rotating nozzle assembly 15 is shown in greater detail in FIGS. 16–21. It is preferably molded from a thermoplastic material and comprises a cylindrical pipe section 36, a nozzle 30 and a male retainer or bracket 32. The pipe section 36 forms the inlet 37 of nozzle 30. The nozzle head 60 has two diverging channels 62, 63 which terminate in respective outlets 48, 49.

U.S. Pat. No. 5,271,561 to Tobias et al is directed to a rotary jet hydrotherapy device and method. A first stage 40 of the outlet 10 includes a water nozzle 42 through which water entering the chamber 24 is dispensed. The first stage 40 has a diffuser 44 composed of a plurality of fins 46 adapted to diffuse any vortex set up in water conducted through the passageway 22 prior to its entry into the nozzle 42. The second stage 52 has external threads 58 for securing it within the chamber 26 and includes a second nozzle 60 and retainer arm 62 for gripping a third stage 64. The system also includes a non-rotating replacement nozzle 78 has a bulbous end 80 which can be retained by the arm 62 of the second stage 52. Thus, if a user would prefer to have a constant, rather than varying flow pattern, the third stage 64 may be removed and replaced with the nozzle 78. Another aspect of the system is an annular adaptor seat 82, which can be used in lieu of the gasket 56. In the embodiment of FIG. 3, the rotatable nozzle 74 is retained in association with the inner race 90 via a snap fit of extensions 96 therein. FIG. 4 shows the jet body 14 equipped with the non-rotating nozzle 78 assembled to the second stage 52 in lieu of the third stage 64, which has been removed.

U.S. Pat. No. 4,508,665 to Spinnett is directed to a retrofit pulsator apparatus and method for an air/water mixer of a swimming pool, therapy tub, spa or the like. As shown in FIGS. 2–7, the pulsator fitting 50 has a molded plastic rotor portion 52 and a molded plastic stator or flow-disturbing member portion 53. Two generally diametrically opposite flow passages 64 and 65 extend completely through the rotor from its upstream end 54 to its downstream end 56. As shown in FIGS. 2 and 3, the rotor 52 is rotatably mounted in the stator bore 70 with the pin 58 projecting outwardly through the socket 74 and the rotor thrust bearing 60 engaging the inner surface of the cross bar juncture 73. To convert the conventional, non-pulsating mixer 10 to the pulsating mixer 51, the existing eyeball 39 and its retaining nut 41 are first removed from the existing outlet and mounting fitting 35. Next, the pulsator fitting 50 is simply screwed into the outlet fitting bore 38 until the pulsator flange 69 contacts the existing mounting flange 37, as shown in FIG. 3.

U.S. Pat. No. 4,407,455 to Sargent is directed to a snap-in rotatable sprinkler. As shown in FIGS. 2–4, the sprinkler 11 includes a body 19, a rotatable sprinkler head 21, and a restrictor or jet 23. The body 19 has an axial passage 31 extending completely through the body. The passage 31 includes cylindrical passage sections 33 and 35 of different diameters forming a smooth shoulder 37. Jet 23 is coaxially mounted within the passage section 33 and is suitably retained against a small shoulder 47. The sprinkler head 21 has one portion 55; which is rotatably received in the passage 31 and a second portion 57 which projects from the body 19. To assemble the sprinkler head 21 and the body 19, the retainer 45 is forced through the passage section 35 to the position shown in FIG. 2 in which the retainer is captured between the shoulder 37 and the face 53 of the jet 23. This snap-fit formed by the retainer 45 and the shoulder 37 facilitates quick assembly and disassembly of the sprinkler 11, thereby facilitating manufacture and cleaning.

U.S. Pat. No. 5,810,257 to Ton is directed to a rotary spa jet. FIG. 5 depicts the face of the nozzle head 60 and illustrates the skewed direction of the outlets 48, 49. When the nozzle head 60 is in the position shown, channel 62 is directed downward and outward, and channel 63 is directed upward and outward. As water passes from each channel's inlet, the radial forces on the walls of the channels 62, 63 cancel, while a downward force is exerted on channel 63 and an upward force is exerted on channel 62.

SUMMARY OF THE INVENTION

In the present invention, a jet housing provides an articulatable, stationary nozzle for directed small area impingement by a jet stream of aerated water. The jet housing also selectively receives a rotary assembly which can be installed over the articulatable nozzle to provide a rotary jet configuration instead. Thus, unlike the noted prior art, the present invention may operate either as a rotary jet or as a stationary jet by either installing or removing a rotary assembly. The nozzle tube is never removed from the assembly, but instead provides an interface for receiving the rotary assembly when it is desired to convert from an articulatable stationary stream to a rotating stream. Conversion in reverse is accomplished simply by removing the rotary assembly which frees the nozzle tube for articulation by limited rotation of an inner eyeball structure.

OBJECTS OF THE INVENTION

It is therefore a principal object of the present invention to provide a whirlpool jet assembly which selectively provides a choice of either rotary or directable stationary jet configurations depending upon whether a rotary assembly is installed in or removed from the jet assembly.

It is another object of the invention to provide a whirlpool jet assembly wherein a user may readily convert from a rotary configuration to a directable stationary configuration by simply pulling out a rotary assembly from the face of the jet assembly.

It is yet another object of the invention to provide a whirlpool jet assembly wherein a user may readily convert from a directably stationary configuration to a rotary configuration by simply pushing a rotary assembly into the face of the jet assembly without removing any component from the jet assembly.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
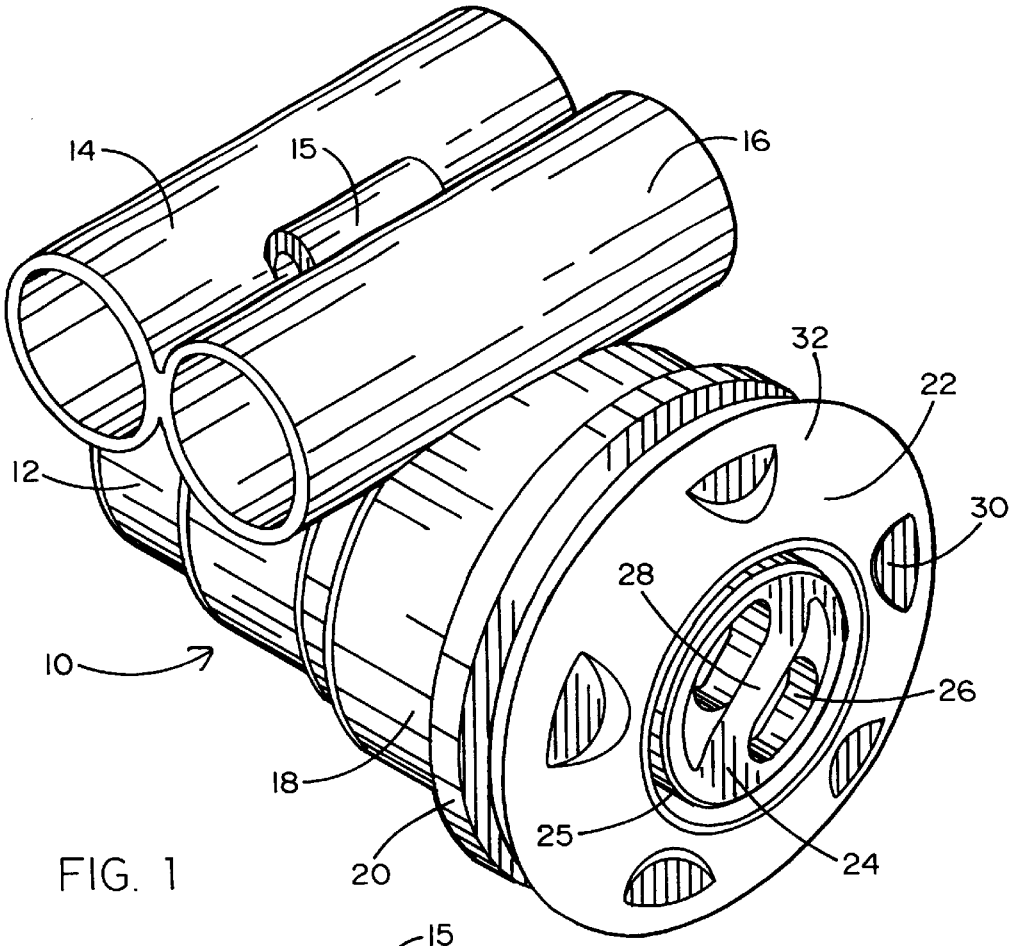
FIG. 1 is a three-dimensional drawing of the jet assembly of the present invention shown configured for rotary operation.

Referring to the accompanying figures, it will be seen that a jet assembly 10 in accordance with the preferred embodiment of the invention, comprises a Venturi body 12 having a water inlet 14 and an air inlet 16. A bracket 15 provides installation support for the pipes attached to the Venturi body 12 when it is secured around the perimeter of a tub. The Venturi body 12 provides a nozzle receptacle 18 terminating in a flange 20 which is designed to abut the external surface of a bathtub wall.

Figure 2:
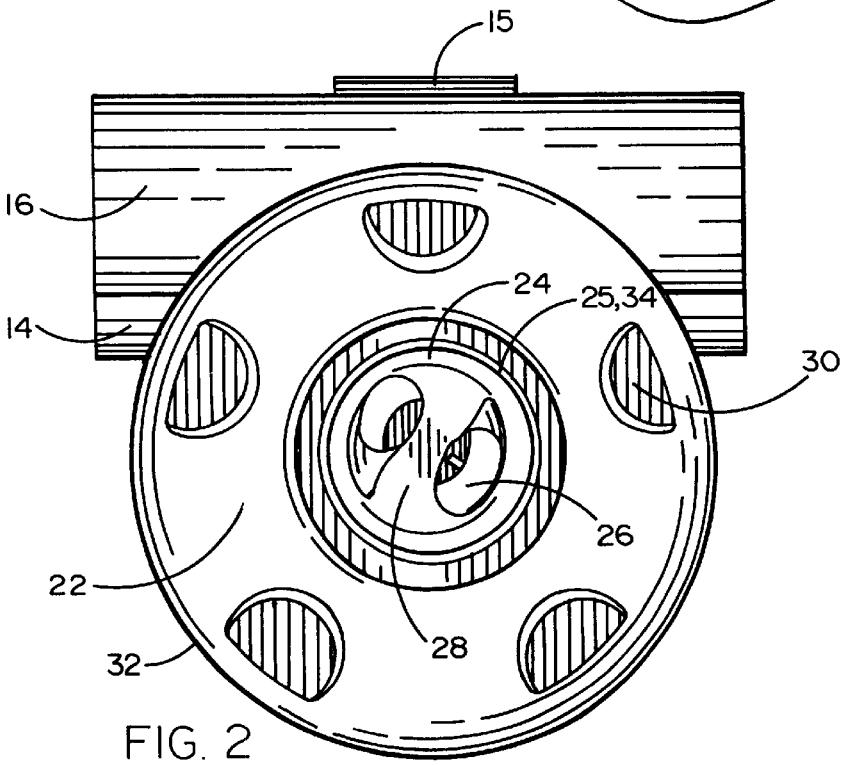
FIG. 2 is a front view of the rotary-configured jet assembly.
Figure 3:
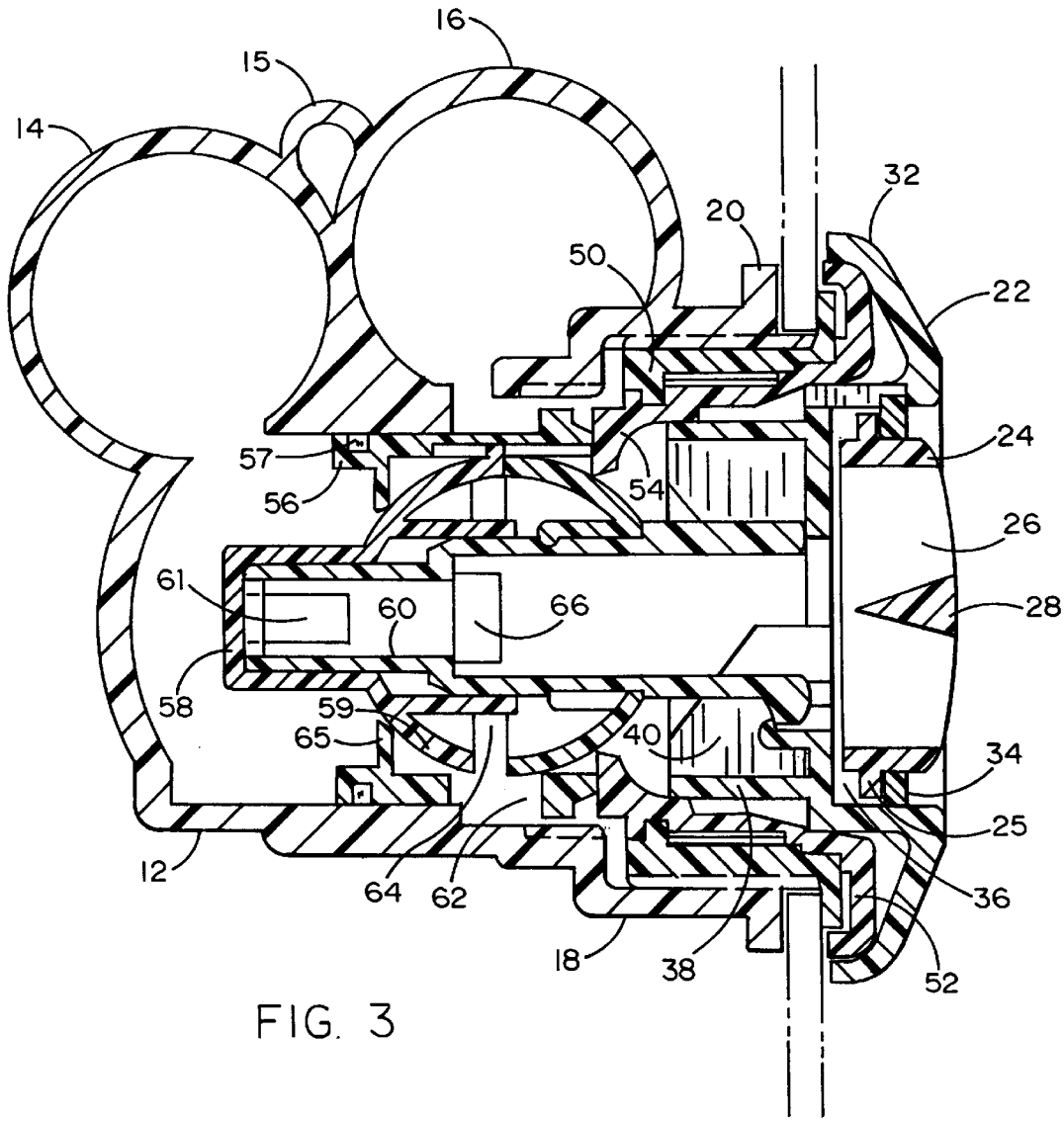
FIG. 3 is a cross-sectional side view of the rotary-configured jet assembly.
Figure 6:
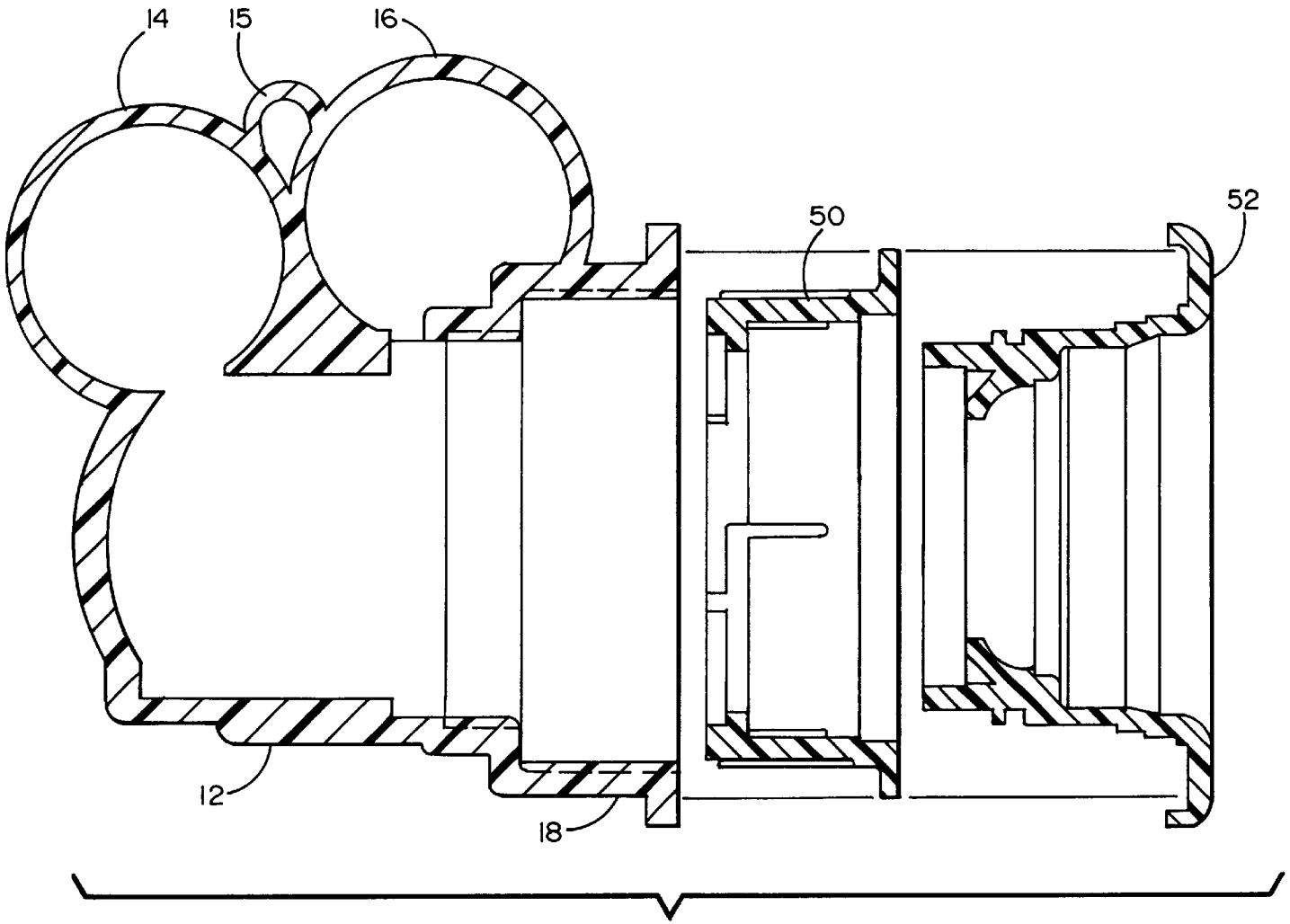
FIG. 6 is an exploded cross-sectional view of the invention with rotary assembly and nozzle/eyeball assembly removed.
Figure 7:
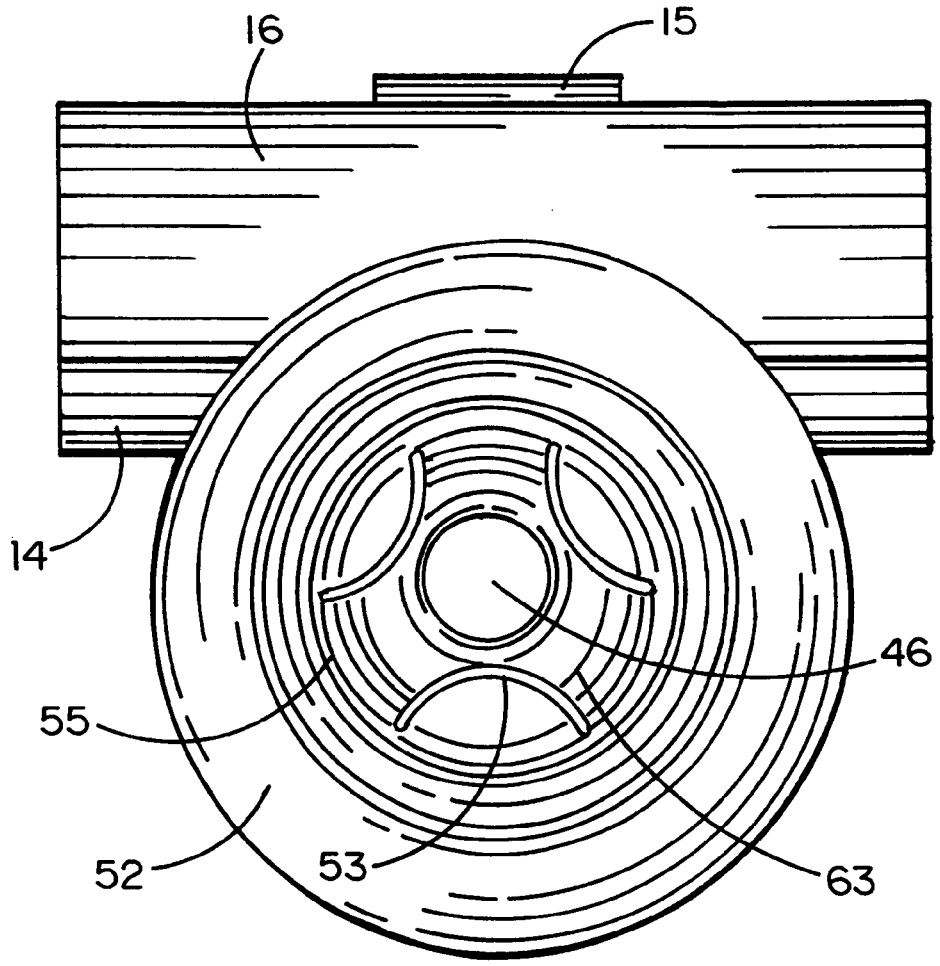
FIG. 7 is a front view of the jet assembly configured for directable stationary operation.

The fully assembled configuration of the jet assembly 10 shown in FIGS. 1–3, also comprises a jet face 22 and a rotor 24. Rotor 24 provides a pair of canted apertures 26 separated by a divider 28. Jet face 22 has a plurality of symmetrically located indentations 30 to facilitate rotation of the face in the rotary mode to adjust the flow rate. Rotor 24 is retained in a rotor chamber 36 in the jet face 22 in a rotatable configuration by its flange 25 held in slidable engagement by a low friction retainer 34. Jet face 22 has a large flange 32 which covers the underlying structure. Jet face 22 is integral to a jet rotor body 38 which is affixed at a junction 54 to an eyeball retainer 56 (discussed below) and has three different mechanisms for securing the jet face and body to the end 63 of a nozzle tube 60. These are a plurality of outer centering lugs 40, a plurality of outer support flanges 44 and a plurality of inner centering lugs 42. As seen in FIG. 7, the nozzle end 63 presents a flow passage 46 terminating in an undulating configuration with alternating inner edges 53 and outer edges 55. The jet face and body are secured to the nozzle end 63 wherein outer centering lugs 40 engage the inner edges 53; the outer support flanges 44 engage the outer edges 55; and the inner centering lugs 42 engage the flow passage 46. This combination along with frictional engagement of jet rotor body 38 with nozzle housing 52 (see FIG. 6), assures firm but releasible attachment of the jet face and body for rotary operation. Moreover, nozzle end 63 is flanged to enhance engagement with support flange 44.

Figure 4:
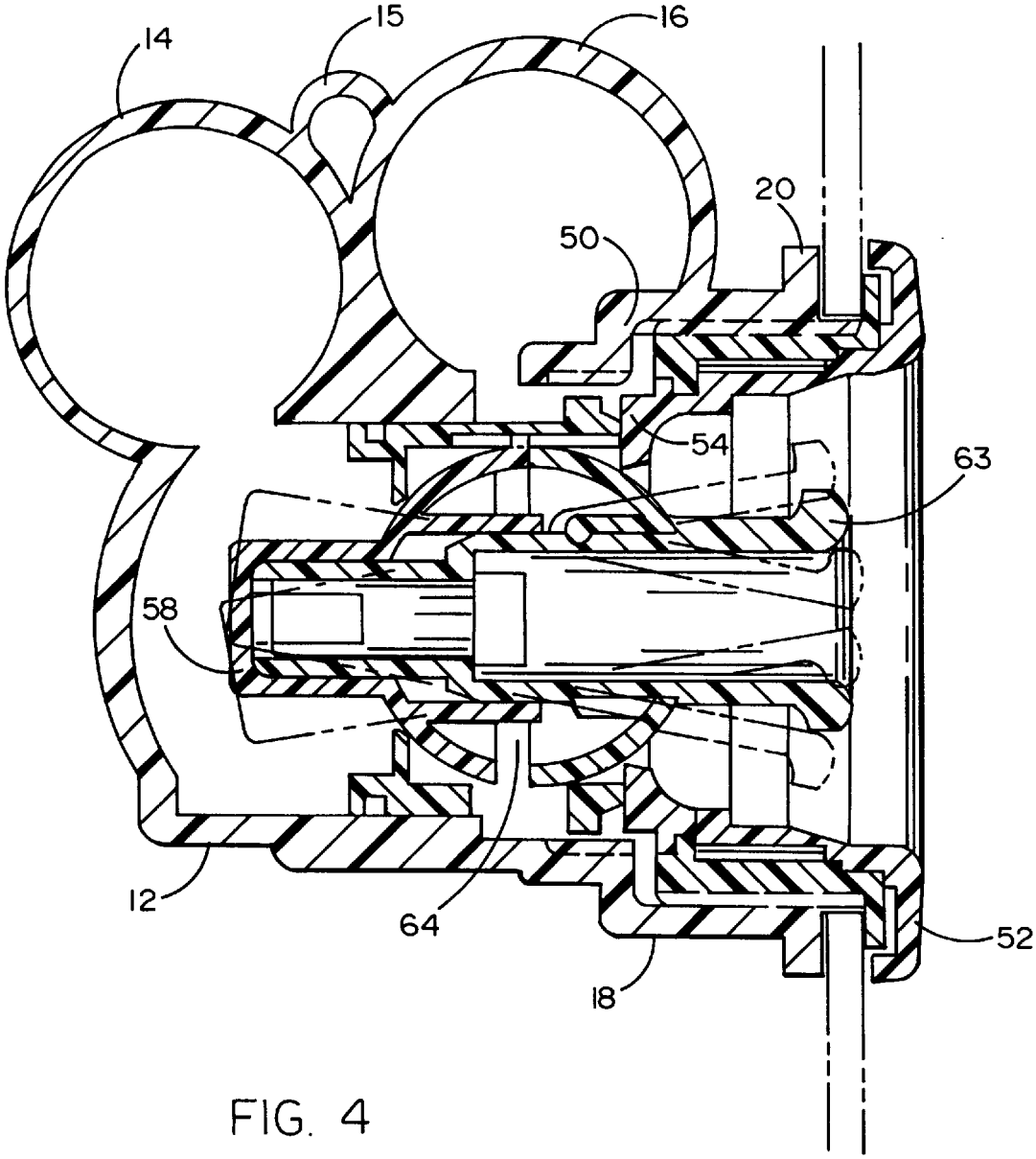
FIG. 4 is a cross-sectional side view similar to that of FIG. 3 but with the rotary assembly removed to provide directable stationary operation.
Figure 5:
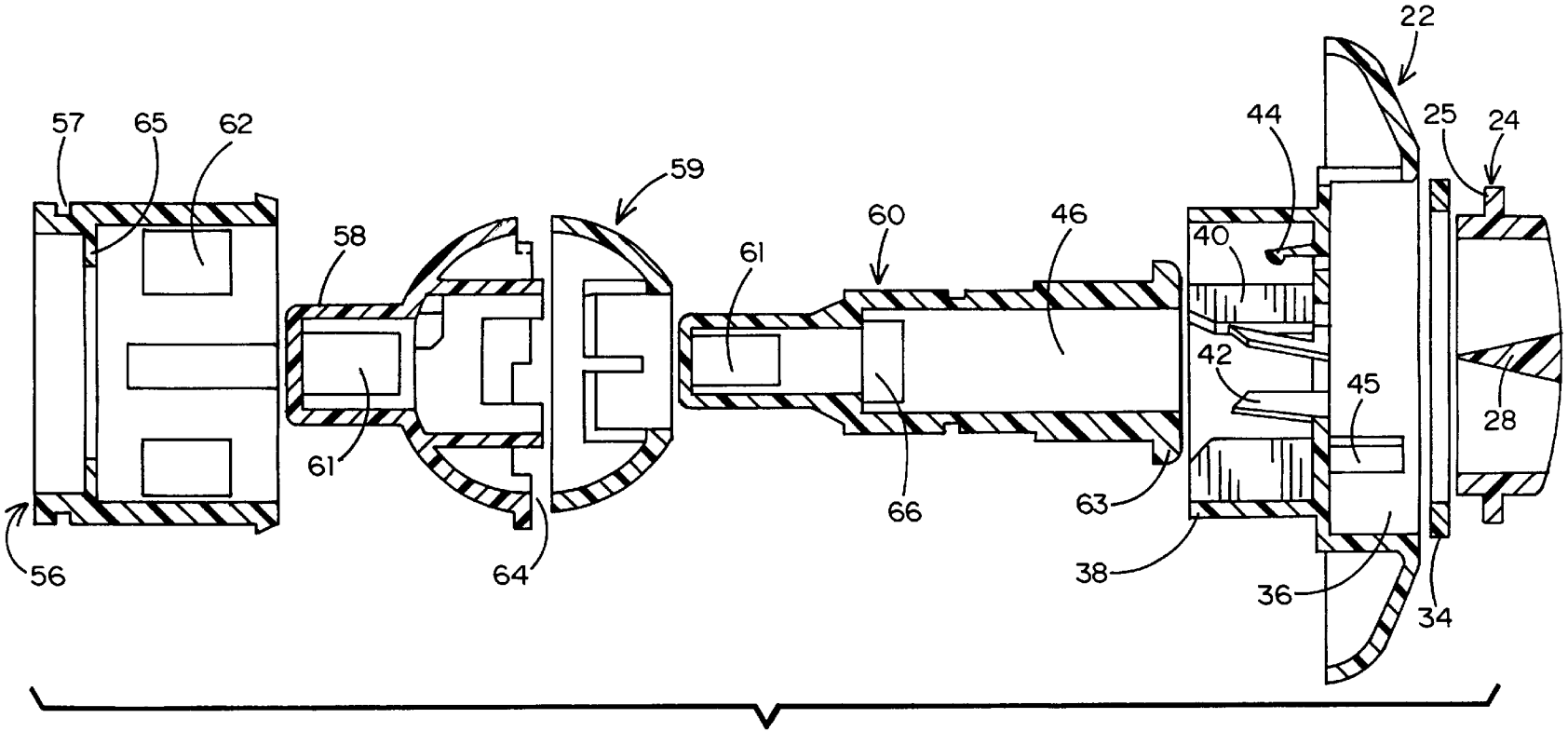
FIG. 5 is an exploded cross-sectional view of the rotary assembly and nozzle/eyeball assembly of the invention.

As seen best in FIGS. 3–5, nozzle tube 60 extends rearwardly into an eyeball 59, the rear end of which comprises a partial enclosure 58. Eyeball 59 is secured for limited articulation within a retainer 56 which provides an O-ring 57 to prevent water from leaking past the eyeball and nozzle during operation. A retainer flange 65 limits the angular motion of the eyeball and nozzle as seen best in FIG. 4. Various gaps and apertures 62, 64 and 66 assure unobstructed air flow into the nozzle tube 60 while an aperture 61 in conjunction with partial enclosure 58, permits adjustment of water flow volume in the nozzle tube by rotation of the tube along its longitudinal axis in both the stationary and rotary modes. Nozzle housing 52 mates with a threaded ring 50 which, in turn, threads into secure engagement with receptacle 18 of Venturi 12 as shown in FIG. 6.

In operation, the assembly is affixed to a tub wall as shown in FIGS. 3 and 4 and Venturi inlets 14 and 16 are attached to water and air lines, respectively. Upon activation of a water pump (not shown), water enters nozzle tube 60 and through Venturi action, sucks air into the flow. If the rotor 24 is installed, the water and air mixture exits through apertures 26 imparting a rotational torque on the rotor which then rotates in place to direct a pair of rotating jets onto a large region of a user's body. If the rotor 24 is removed (along with body 38) the user is free to adjust the nozzle tube 60 by grasping end 63 to direct a stationary flow onto a smaller region of the user's body.

Thus, it will be seen that all of the aforementioned objects are satisfied by the illustrated embodiment wherein by simply installing or removing the rotor and rotor body, the user can select either rotary flow or directed stationary flow without removing any other components of the assembly.

Having thus described a preferred embodiment of the invention, it being understood that many variations are contemplated, what is claimed is:

1. A whirlpool jet assembly comprising;

a Venturi housing having a water inlet and an air inlet for generating a stream of mixed water and air through an aperture in the wall of a water-holding enclosure;

a non-rotatable nozzle tube and eyeball positioned concentrically within said housing and in fluid communication with said water inlet and said air inlet for directing said stream through said nozzle tube through said aperture in a direction determined by the orientation of said eyeball;

a rotary assembly engaging said nozzle tube in releasable manner for selective conversion of said whirlpool jet assembly between a rotary configuration and a directable stationary configuration, said rotary assembly in said rotary configuration concentrically engaging said nozzle tube and having a plurality of canted apertures for passing said stream and generating rotational spin in said rotary assembly for spraying water and air over a circular pattern, said rotary assembly in said directable stationary configuration being removed from said nozzle tube.

2. The whirlpool jet assembly recited in claim 1 wherein said rotary assembly comprises a plurality of lugs for engaging said nozzle tube.

3. The whirlpool jet assembly recited in claim 1 wherein said rotary assembly comprises a divider for dividing said stream into respective ones of said canted apertures.

4. The whirlpool jet assembly recited in claim 1 further comprising flow control means for adjusting the amount of water and air flowing through said nozzle tube.

5. The whirlpool jet assembly recited in claim 1 where upon removal of said rotary assembly, said nozzle tube and said eyeball may be oriented at a selected angle relative to said wall aperture.

6. The jet assembly recited in claim 1 further comprising means for engaging opposite surfaces of a water-holding enclosure at the perimeter of a hole in said enclosure.

7. A whirlpool jet assembly selectively convertible between first and second configurations comprising both an articulatable non-rotating nozzle and a removable rotary face, said rotary face in said first configuration being operably coupled to said nozzle for operation of said whirlpool jet assembly in a rotary mode, and in said second configuration removed from said nozzle for operation of said whirlpool jet assembly in a directable stationary mode, the nozzle being articulatable for directing a stream of water and air at a selected spot, the rotary face having rotation apertures for directing a stream of water and air over a region, said rotary face being in fluid communication with said nozzle for rotating said rotating apertures in response to water and air flow through said nozzle, said nozzle being articulatable upon removal of said rotary face from said whirlpool jet assembly.

8. The jet assembly recited in claim 7 wherein said rotary face is attached to said nozzle by a plurality of lugs which engage an end of said nozzle.

9. The jet assembly recited in claim 7 wherein said rotary face comprises a divider for dividing said stream of water and air into separated streams which flow through respective rotating apertures to impart a rotational torque to said rotary face.

10. The whirlpool jet assembly recited in claim 7 further comprising flow control means for adjusting the amount of water and air flowing through said nozzle.

11. The jet assembly recited in claim 7 further comprising means for engaging opposite surfaces of a water-holding enclosure at the perimeter of a hole in said enclosure.

12. The whirlpool jet assembly recited in claim 7 where upon removal of said rotary assembly, said nozzle tube and said eyeball may be oriented at a selected angle relative to said wall aperture.

* * * * *